US010609489B2

(12) United States Patent
Guthy et al.

(10) Patent No.: US 10,609,489 B2
(45) Date of Patent: Mar. 31, 2020

(54) FABRICATING AN INTEGRATED LOUDSPEAKER PISTON AND SUSPENSION

(71) Applicant: Bose Corporation, Framingham, MA (US)

(72) Inventors: Csaba Guthy, Hopkinton, MA (US); Ole Mattis Nielsen, Waltham, MA (US); Mark A. Hayner, Belmont, MA (US)

(73) Assignee: Bose Corporation, Framingham, MA (US)

( * ) Notice: Subject to any disclaimer, the term of this patent is extended or adjusted under 35 U.S.C. 154(b) by 164 days.

(21) Appl. No.: 15/222,539

(22) Filed: Jul. 28, 2016

(65) Prior Publication Data

US 2017/0078800 A1 Mar. 16, 2017

Related U.S. Application Data

(60) Provisional application No. 62/216,755, filed on Sep. 10, 2015.

(51) Int. Cl.

| | |
|---|---|
| ***H04R 9/06*** | (2006.01) |
| ***H04R 31/00*** | (2006.01) |
| *H04R 9/04* | (2006.01) |
| *H04R 7/20* | (2006.01) |
| *H04R 7/04* | (2006.01) |

(52) U.S. Cl.

CPC ..... *H04R 9/06* (2013.01); *H04R 31/00* (2013.01); *H04R 7/04* (2013.01); *H04R 7/20* (2013.01); *H04R 9/04* (2013.01); *H04R 31/003* (2013.01); *H04R 31/006* (2013.01); *H04R 2201/003* (2013.01); *H04R 2231/003* (2013.01); *H04R 2307/025* (2013.01); *H04R 2307/204* (2013.01)

(58) Field of Classification Search

None

See application file for complete search history.

(56) References Cited

U.S. PATENT DOCUMENTS

| | | | | |
|---|---|---|---|---|
| 4,817,165 A * | 3/1989 | Amalaha | ..... | H04R 7/122 181/170 |
| 6,847,090 B2 | 1/2005 | Loeppert | | |
| 9,961,447 B2 | 5/2018 | Windischberger et al. | | |

(Continued)

FOREIGN PATENT DOCUMENTS

| | | |
|---|---|---|
| CN | 101373713 A | 2/2009 |
| CN | 102948170 A | 2/2013 |
| CN | 103283260 A | 9/2013 |

OTHER PUBLICATIONS

Invitation to Pay Additional Fees dated Nov. 25, 2016 for International application No. PCT/US2016/050778.

(Continued)

*Primary Examiner* — Abul Kalam

(74) *Attorney, Agent, or Firm* — Bose Corporation

(57) ABSTRACT

A diaphragm and suspension for an electroacoustic transducer are formed by depositing a layer of compliant material on a first surface of a solid substrate and removing material from a second surface of the solid substrate. The removal leaves a block of substrate material suspended within an inner perimeter of an outer support ring of the substrate material by the compliant material, the block providing the diaphragm.

15 Claims, 12 Drawing Sheets

(56) References Cited

U.S. PATENT DOCUMENTS

| | | | | |
|---|---|---|---|---|
| 2008/0123242 | A1* | 5/2008 | Zhou | H01G 5/011 361/290 |
| 2012/0160598 | A1* | 6/2012 | Silver | H04R 7/20 181/172 |
| 2013/0156253 | A1* | 6/2013 | Lemarquand | B81B 3/007 381/396 |
| 2015/0001651 | A1 | 1/2015 | Faralli et al. | |

OTHER PUBLICATIONS

Shahosseini, Iman, et al.: "Optimization and Microfabrication of High Performance Silicon-Based MEMS Microspeaker," IEEE Sensors Journal, IEEE Service Center, New York, NY, US, vol. 13, No. 1, Jan. 1, 2013 (Jan. 1, 2013), pp. 273-284, XP011486310, ISSN: 1530-437X, DOI: 10.1109/JSEN.2012.2213807, Table I; Section IV.; figures 1,3,11.

International Search Report and Written Opinion dated Jan. 23, 2017 for International application No. PCT/US2016/050778.

Lemarquand, G., et al. "MEMS electrodynamic loudspeakers for mobile phones", Applied Acoustics, Oct. 28, 2011; Journal Homepage: www.elsevier.com/locate/apacoust.

Sturtzer, E., et al. "High Fidelity MEMS Electrodynamic Micro-Speaker Characterization" Journal of Applied Physics, American Institute of Physics (AIP), 2013, pp. 9.

Je, S., et al., "A Compact and Low-Cost MEMS Loudspeaker for Digital Hearing Aids", IEEE Transactions on Biomedical Circuits and Systems, vol. 3, No. 5, Oct. 2009.

Shahosseini, I., et al., "Design of the silicon membrane of high fidelity and high efficiency MEMS microspeaker", DTIP , May 11-13, 2011, Aix-en-Provence, France, EDA Publishing ISBN: 978-2-35500-013-3.

Chen, Y.C., et al., "A Low-Power Milliwatt Electromagnetic Microspeaker Using a PDMS Membrane for Hearing Aids Application", Microsystems Integration Laboratory, Department of Electronics Engineering & Institute of Electronics, National Chiao Tung University, Taiwan, MEMS 2011, Cancun, Mexico, Jan. 23-27, 2011, IEEE, ISBN: 978-1-4244-9634-1/11.

Shahosseini, I., et al., "Silicon-based MEMS microspeaker with large stroke electromagnetic actuation", DTIP , Apr. 25-27, 2012, Cannes, France, EDA Publishing, 2012.

Shahosseini, I., et al., "Towards High Fidelity High Efficiency MEMS Microspeakers", IEEE Sensors 2010 Conference, ISBN: 978-1-4244-8168-2/10.

Lefeuvre, E., et al., "Potential of MEMS technologies for manufacturing of high-fidelity microspeakers", SociétéFrançaise d'Acoustique. Acoustics 2012, Apr. 2012, Nantes, France.

Shahosseini, I., et al., "Effciency optimization of an electrodynamic MEMS microspeaker," Société Française d'Acoustique. Acoustics 2012, Apr. 2012, Nantes, France.

Je, S., et al., "A Compact, Low-Power, and Electromagnetically Actuated Microspeaker for Hearing Aids", IEEE Electron Device Letters, vol. 29, No. 8, Aug. 2008.

CN Office Action dated Oct. 31, 2019 for CN Appln. No. 20168006072601.

* cited by examiner

FABRICATING AN INTEGRATED LOUDSPEAKER PISTON AND SUSPENSION

PRIORITY CLAIM

This application claims priority to U.S. Provisional patent application 62/216,755, filed Sep. 10, 2015, the entire contents of which are incorporated here by reference.

BACKGROUND

This disclosure relates to a process for fabricating an integrated loudspeaker diaphragm and suspension, and the resulting product.

Prior art use of MEMS techniques to create electroacoustic transducers (loudspeakers or microphones) generally attempt to form the entire transducer in the MEMS package—that is, both the diaphragm that radiates or is moved by sound and the voice-coil or other electro-mechanical transducer that moves or senses movement of the diaphragm are formed in or on a single silicon or other semiconductor substrate. See, for example, U.S. Patent Application 2013/0156253. Conventional loudspeakers, on the other hand, have numerous discrete parts, including, in a typical example, a diaphragm or other sound-radiating surface, a suspension, a housing, and a voice coil.

SUMMARY

In general, in one aspect, forming an electroacoustic transducer having a diaphragm and suspension includes depositing a layer of compliant material on a first surface of a solid substrate and removing material from a second surface of the solid substrate. The removal leaves a block of substrate material suspended within an inner perimeter of an outer support ring of the substrate material by the compliant material, the block providing the diaphragm.

Implementations may include one or more of the following, in any combination. The compliant material may have an elastic strain limit of at least 50 percent. The compliant material may be cured. The compliant material may have an elastic strain limit of at least 150 percent. The compliant material may include liquid silicone rubber (LSR). The step of removing material from the substrate may include removing material from a portion of the substrate in some areas to form the block, and removing all material of the substrate in other areas to form a gap between the inner perimeter of the outer support ring and the suspended block. The step of removing material from the substrate may include deep reactive ion etching (DRIE), material being removed from a portion of the substrate by a single DRIE etch, and material being removed from the entire substrate by multiple DRIE etches. The substrate may include a silicon-on-insulator (SOI) wafer, and the step of depositing the layer of compliant material may be performed after the step of removing material from a portion of the substrate to form the block, but before the step of removing all material from other areas to form the gap. The step of removing material from the substrate may include deep reactive ion etching (DRIE), material being removed from a portion of the substrate by a single DRIE etch, and material being removed from the entire substrate by multiple DRIE etches through the main Si wafer, an etch of the insulator layer, and an etch of the top Si layer. The substrate may include a silicon wafer, and the step of depositing the layer of compliant material may be performed before the steps of removing material from the substrate.

Removing material from the substrate may leave the block having a side wall retaining most of the thickness of the substrate around an outer perimeter of the block facing the inner perimeter of the outer support ring, and a thinner portion of the substrate remaining bounded by the side wall leaving a void in the interior of the block. A bobbin may be attached to the block, the bobbin being located adjacent to an inter perimeter of the side wall. The bobbin may be attached to the block by adhesive, the adhesive being contained by the side wall such that it may not contact the suspension. The side wall of the block may act as an alignment guide for the attachment of the bobbin.

Removing material from the substrate may leave the outer support ring having a wall retaining most of the thickness of the substrate and forming the inner perimeter of the outer support ring, and a thinner portion of the substrate at the top of the wall forming a lip around an outer perimeter of the outer support ring. A ferromagnetic housing may be attached to the outer support ring, the housing being located adjacent to an outer perimeter of the outer support ring wall and the lip. The housing may be attached to the outer support ring by adhesive, the adhesive being prevented by the side wall from contacting the suspension between the block and the outer support ring. The outer support ring may act as an alignment guide for the attachment of the housing. The compliant material may be cut through at the location of an outer perimeter of the outer support ring, separating the block, the outer support ring, and the compliant layer suspending the block within the outer support ring from the substrate. An inner perimeter of the silicon substrate surrounding the outer support ring may align a cutting tool for cutting through the compliant material. The step of cutting may be performed after the step of attaching the ferromagnetic housing to the outer support ring. The ferromagnetic housing may align a cutting tool for cutting through the compliant material.

The step of removing material may form a plurality of diaphragms and corresponding outer support rings over the area of the substrate. A plurality of bobbins may be attached to the diaphragms and a plurality of housings may be attached to the outer support rings, simultaneously, while the diaphragm and outer support rings remain attached to the substrate and each other by the layer of compliant material. The compliant material may be cut through at the locations of the plurality of outer support rings, the plurality of housings serving as alignment guides for a cutting tool.

In general, in one aspect, a diaphragm and suspension assembly for an electroacoustic transducer includes a piston made of a disk of silicon having a flat surface and serving as the diaphragm, and a support ring of silicon surrounding the piston and separated from the piston by a gap. A layer of compliant material adhered to a top surface of the support ring and to the flat surface of the piston suspends the piston in the gap.

Implementations may include one or more of the following, in any combination. The piston may include a void within the disk of silicon, bounded by a perimeter wall of the disk and the top surface of the disk. The support ring may include an inner perimeter wall of silicon facing the gap, and an outer lip having less height than the inner perimeter wall. The compliant material may have an elastic strain limit of at least 50 percent. The compliant material may have an elastic strain limit of at least 150 percent. The compliant material may have a Young's modulus and a thickness that together result in the compliant material surrounding the piston in the gap having a mechanical stiffness in the range of 5-100 N/m. The compliant material includes liquid silicone rubber (LSR). The support ring may have an outer diameter of around 4 mm. The piston may have a thickness between 10 and 100 μm. The piston may have a thickness of about 50 μm. The layer of compliant material may be between 10 and 500 μm thick. The layer of compliant material may be around 50 μm thick.

In general, in one aspect, an electro-acoustic transducer includes a piston made of a disk of silicon having a flat surface and serving as a diaphragm of the transducer, a support ring of silicon surrounding the piston and separated from the piston by a gap, a layer of compliant material adhered to a top surface of the support ring and to the flat surface of the piston, suspending the piston in the gap, a bobbin coupled to the piston, a ferromagnetic housing coupled to the support ring, and a magnet/voice-coil system coupled to the housing and bobbin for converting electrical current to motion of the piston.

Implementations may include one or more of the following, in any combination. The piston disk may include a perimeter wall and the top surface bounding a void within the disk, and the bobbin may be adjacent to an inner perimeter of the perimeter wall of the disk. The support ring may include an inner perimeter wall of silicon facing the gap, and an outer lip having less height than the inner perimeter wall, and the ferromagnetic housing may be adjacent to an outer perimeter surface of the inner perimeter wall and a bottom surface of the outer lip.

In general, in one aspect, forming a diaphragm and suspension for an electroacoustic transducer from a silicon-on-insulator (SOI) wafer having a top layer of Si, an intermediate layer of SiO2, an inner layer of Si, and a bottom layer of SiO2, includes:

a) coating the bottom layer of SiO2 with first photoresist,
b) masking the bottom of the wafer and exposing the wafer to a light source corresponding to the first photoresist,
c) developing the photoresist,
d) etching the bottom SiO2 layer, the etching masked by the photoresist,
e) stripping the first photoresist and coating the bottom of the wafer with a second coat of photoresist,
f) masking the bottom of the wafer and exposing the wafer to a light source corresponding to the second photoresist,
g) developing the second photoresist,
h) deep reactive ion etching (DRIE) through a first thickness of Si on the bottom of the wafer, less than the full thickness of the inner layer of Si, the etching masked by the second photoresist,
i) stripping the second photoresist,
j) DRIE etching from the bottom of the wafer through the complete thickness of the inner Si layer at the locations where the first DRIE etch was performed, the etching masked by the SiO2 left after the first etching of the SiO2, portions of the inner Si layer having the first thickness remain in the area masked by the photoresist during the first DRIE etch, forming the plate of the diaphragm and the top surface of a support ring, and the areas masked by the SiO2 form walls of the diaphragm and support ring,
k) etching the remaining portions of the bottom SiO2 layer and portions of the top SiO2 layer now exposed by the areas etched completely through the inner Si layer,
l) applying a layer of liquid silicone rubber (LSR) on the top of the wafer, and
m) etching through portions of the top Si layer exposed by the areas etched completely through the inner Si layer and upper SiO2 layer, leaving the diaphragm suspended from the support ring by the LSR where both layers of Si were removed.

In general, in one aspect, forming a piston and suspension for an electroacoustic transducer, includes n) growing first and second layers of SiO2 on top and bottom surfaces of a Si wafer,
o) depositing a layer of Cr on the first layer of SiO2,
p) coating a layer of liquid silicone rubber (LSR) on the Cr layer,
q) coating the top and bottom of the wafer with photoresist,
r) masking the bottom of the wafer and exposing the wafer to a light source corresponding to the photoresist,
s) developing the photoresist,
t) reactive ion etching (RIE) or HF etching the bottom SiO2 layer,
u) stripping the exposed photoresist and coating the wafer with a new coat of photoresist,
v) again masking the bottom of the wafer and exposing the wafer to a light source corresponding to the photoresist,
w) again developing the photoresist,
x) deep reactive ion etching (DRIE) through a first thickness of Si on the bottom of the wafer,
y) stripping the bottom layer of photoresist,
z) DRIE etching from the bottom of the wafer through the complete thickness of Si at the locations where the first DRIE etch was performed, the etching masked by the SiO2, portions of the Si having the first thickness remain in the area masked by the photoresist during the first DRIE etch, forming the plate of the diaphragm and the top surface of a support ring, the areas masked by the SiO2 form rings of the diaphragm and support ring, and the diaphragm may be suspended from the support ring by the LSR where the Si was completely removed, and
aa) removing the remaining exposed SiO2 and photoresist.

Advantages include simplifying subsequent assembly steps by integrating the suspension, diaphragm, and part of the housing into a single part with the suspended element integrally connected to the suspension and non-suspended element. Additional advantages include enhanced mechanical tolerances not possible with traditional macrofabrication techniques for some components while retaining high motor constant and efficiency of the traditionally fabricated motor structure.

All examples and features mentioned above can be combined in any technically possible way. Other features and advantages will be apparent from the description and the claims.

DESCRIPTION

Figure 1:
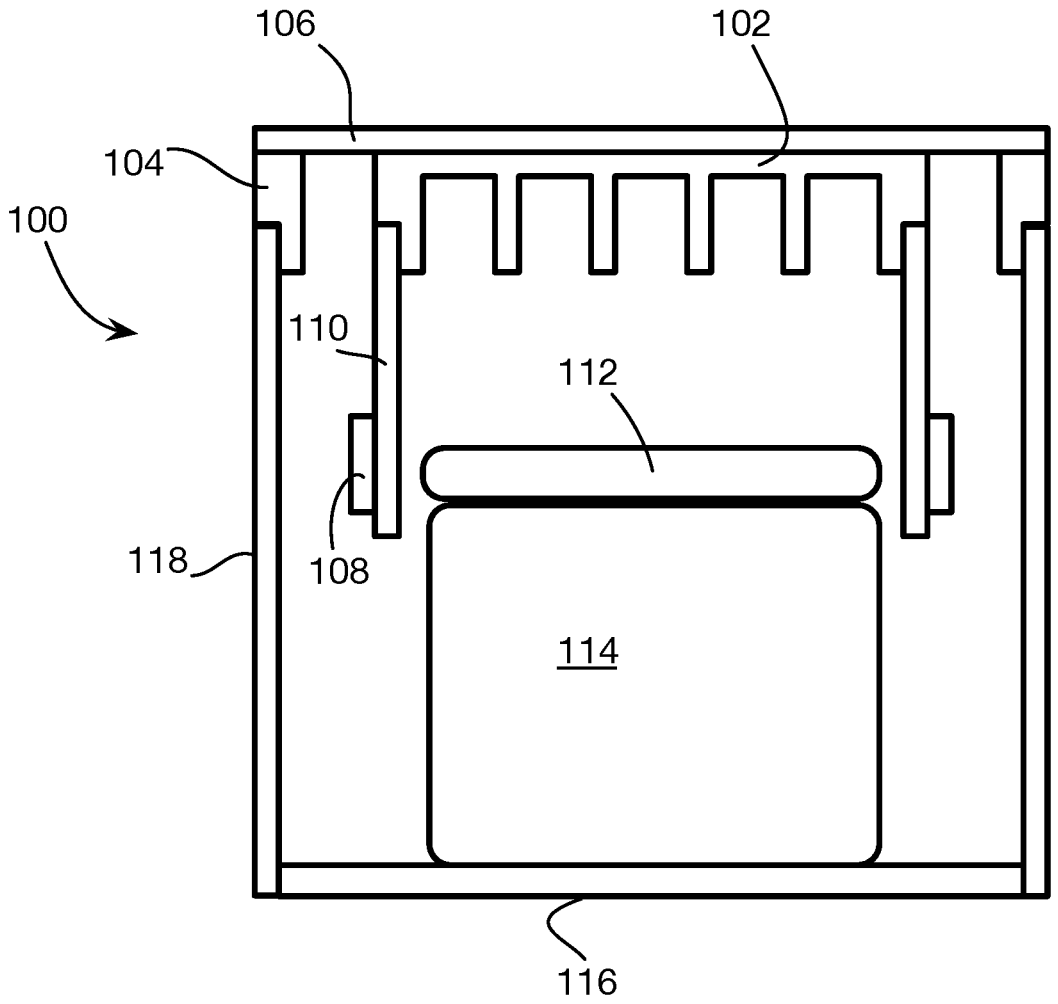
FIG. 1 shows a cross-sectional view of a complete electro-acoustical transducer.

As shown in FIG. 1, an electro-acoustic transducer 100 built using the technique disclosed below includes a diaphragm 102 suspended from a support ring 104 by a suspension 106. Unlike conventional loudspeaker suspensions, the suspension 106 consists of a layer of compliant material extending over the entire surface of the diaphragm, as shown more clearly in FIG. 2A. The diaphragm itself also differs from typical loudspeaker diaphragms, in that its radiating surface is a flat plane, hence we refer to it as a piston. The remaining parts of the transducer match those of a conventional electro-dynamic loudspeaker: a voice coil 108 wound around a bobbin 110, surrounding a coin 112 and magnet 114. The coin 112 and magnet 114 are connected to the support ring by a back plate 116 and housing 118, which, like the coin, are formed of ferromagnetic material, such as steel. Electrical current flowing through the voice coil within the field produced by the magnet 114 and shaped by the ferromagnetic parts produces a force on the voice coil in the axial direction. This is transferred to the piston 102 by the bobbin 110, resulting in motion of the piston, and the production of sound. The same effects can be used in reverse to produce current from sound, i.e., using the transducer as a microphone or other type of pressure sensor. In other examples, the voice coil is stationary and the magnet moves. Such a small transducer is described, aside from the fabrication of the piston and suspension as disclosed below, in U.S. patent application Ser. No. 15/182,069, Miniature Device Having an Acoustic Diaphragm, filed Jun. 14, 2016, the entire contents of which are incorporated here by reference.

One potential material for the compliant suspension is liquid silicone rubber (LSR), a product based on polydimethylsiloxane (PDMS). To properly suspend the piston, while allowing it to move as needed at acoustic frequencies, the material of the suspension should have an elastic strain limit of at least 50 percent and a Young's modulus and thickness resulting in mechanical stiffness of the suspension in the range of 5-100 N/m. Various elastomers will meet this requirement. LSR is one example. In addition, even larger elastic strain limits, as high as 100 or 150 percent may be desired to accommodate large forces applied to the transducer when an ear-sealing earbud of which it is a component is inserted into or removed from an ear canal. Conversely, for applications where less displacement is needed, an elastic strain limit as low as 10 percent may be sufficient.

Figure 2A:
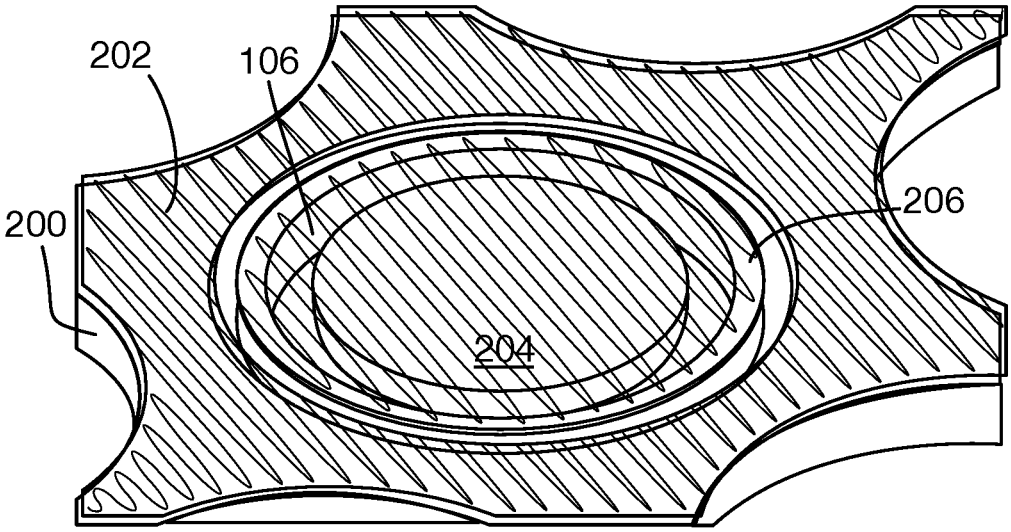
FIGS. 2A, 2B, and 2C show a top perspective, bottom perspective, and cross-sectional view of the diaphragm and suspension of the transducer.
Figure 2B:
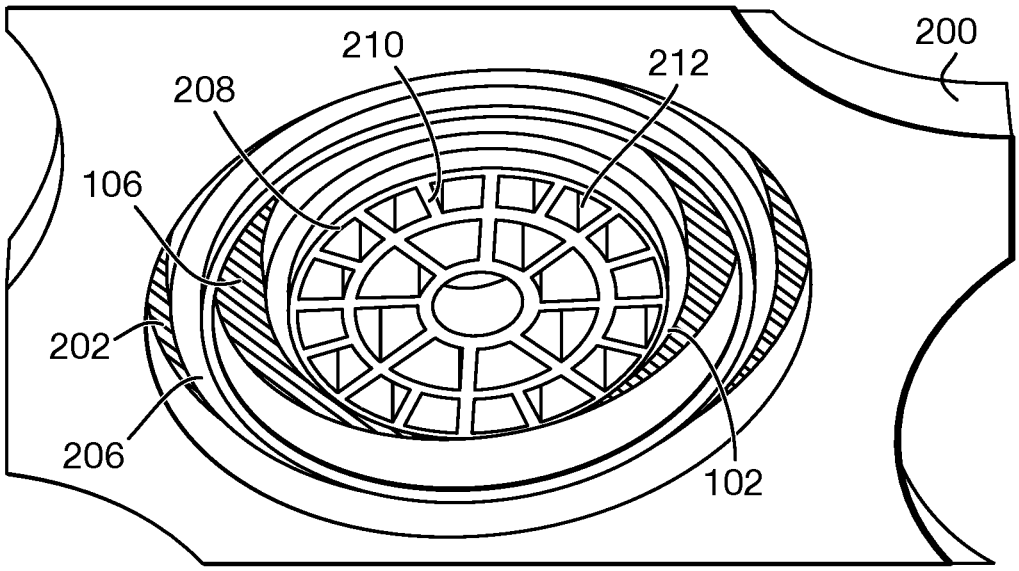
Figure 2C:
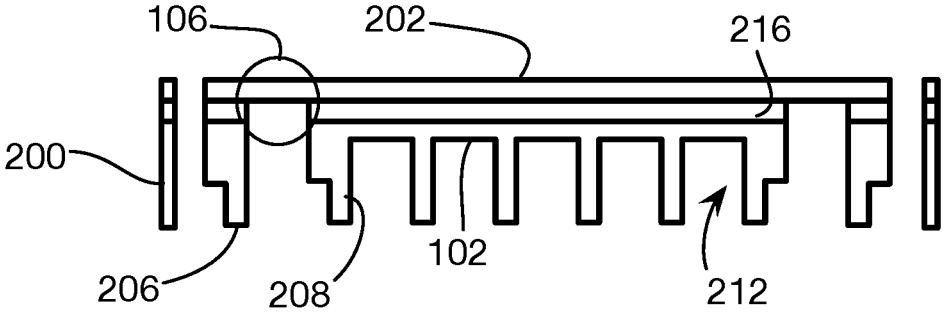

The piston and suspension are shown in more detail in FIGS. 2A-2C. FIGS. 2A and 2B show top and bottom views of the piston and suspension surrounded by the silicon substrate 200 from which they are formed. In FIG. 2A, the layer of material 202 (wavy lines) from which the suspension 106 is formed can be seen to extend over the entire top surface 204 of the piston 102, and over the support ring 206 that forms the top edge of the housing 104 in FIG. 1. The material 202 is cut out above the gap between the support ring 206 and the surrounding substrate in FIGS. 2A and 2C but intact in FIG. 2B, to assist in visualizing the construction. The bottom view 2B and side sectional view 2C show that the underside of the piston may consist of a pattern of rings 208 and ribs 210, with voids 212 between them etched in the silicon. This provides stiffness to the silicon piston while decreasing its weight relative to a solid disk. In other examples, a flat plate of silicon is sufficiently stiff, and the ribs and rings are not needed for stiffness, though similar structures, or just the outermost ring 208, may be needed due to the fabrication process, as discussed below. The sectional view also shows a layer 216 of $SiO_2$, which will be explained below.

Figure 3A:
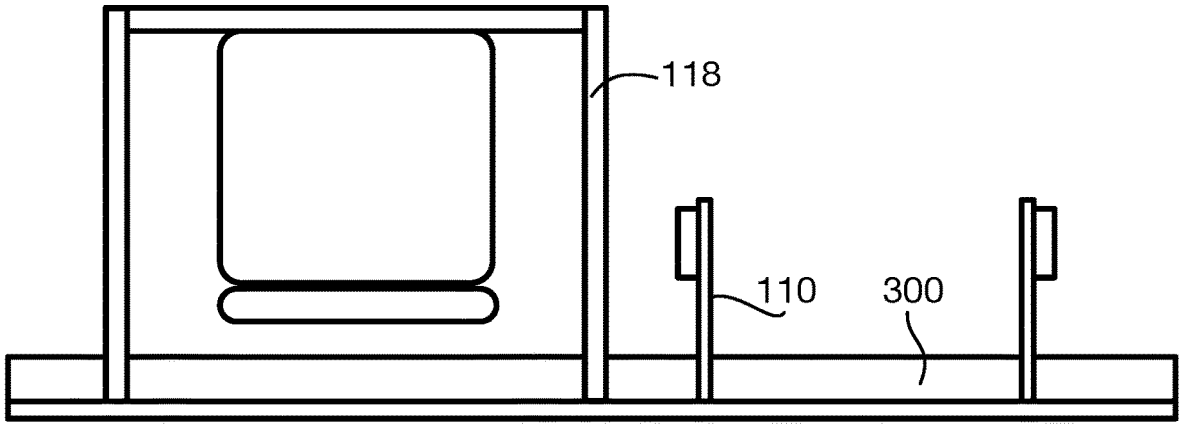
FIGS. 3A and 3B show an assembly process for the transducer.
Figure 3B:
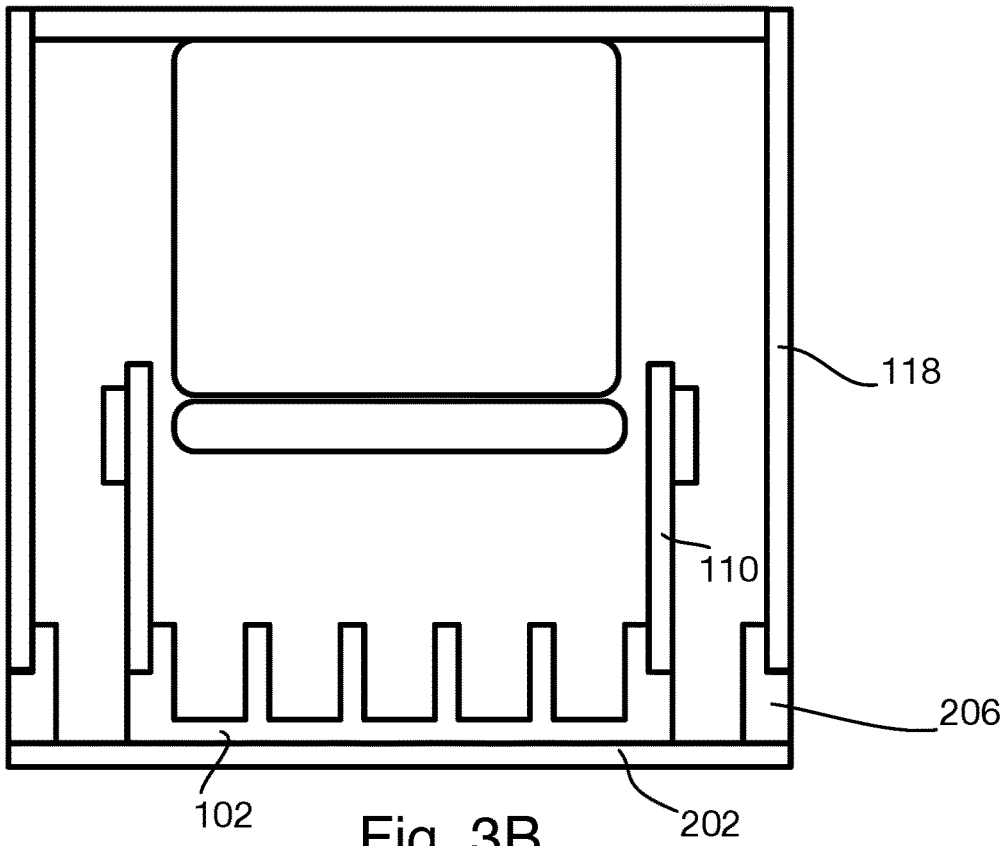

FIGS. 3A and 3B show one example of how the piston and suspension can be connected to the rest of the transducer. In FIG. 3A, the housing and bobbin, with the magnet, coin, back plate, and voice coil already assembled to them, are dipped into a shallow pool of adhesive 300 in order to apply a uniform bead of adhesive to one end of the housing. Preferably, the bead is sized to fill the gap between the outer support ring and the inner surface of the housing without excessive squeeze-out of adhesive. In other examples, the magnet, coin, and back plate are not attached until later. Then, in FIG. 3B, the bobbin is set on the piston 102, and the housing 118 is set on the outer ring 206. The adhesive is cured, and the transducer is ready for further processing, such as attaching or dressing lead-outs from the voice coil. In some example, the lead-outs extending from the voice coil are dressed before the bobbin is attached to the piston. In some examples, the bobbin and housing are attached to the piston and ring, respectively, before the ring is cut away from the rest of the substrate. This can make it easier to fix the location of the piston and ring when making the attachment. Further, a large number of bobbins and housings can be attached to a full wafer of pistons and rings all at once, using an appropriate fixture.

Figure 4:
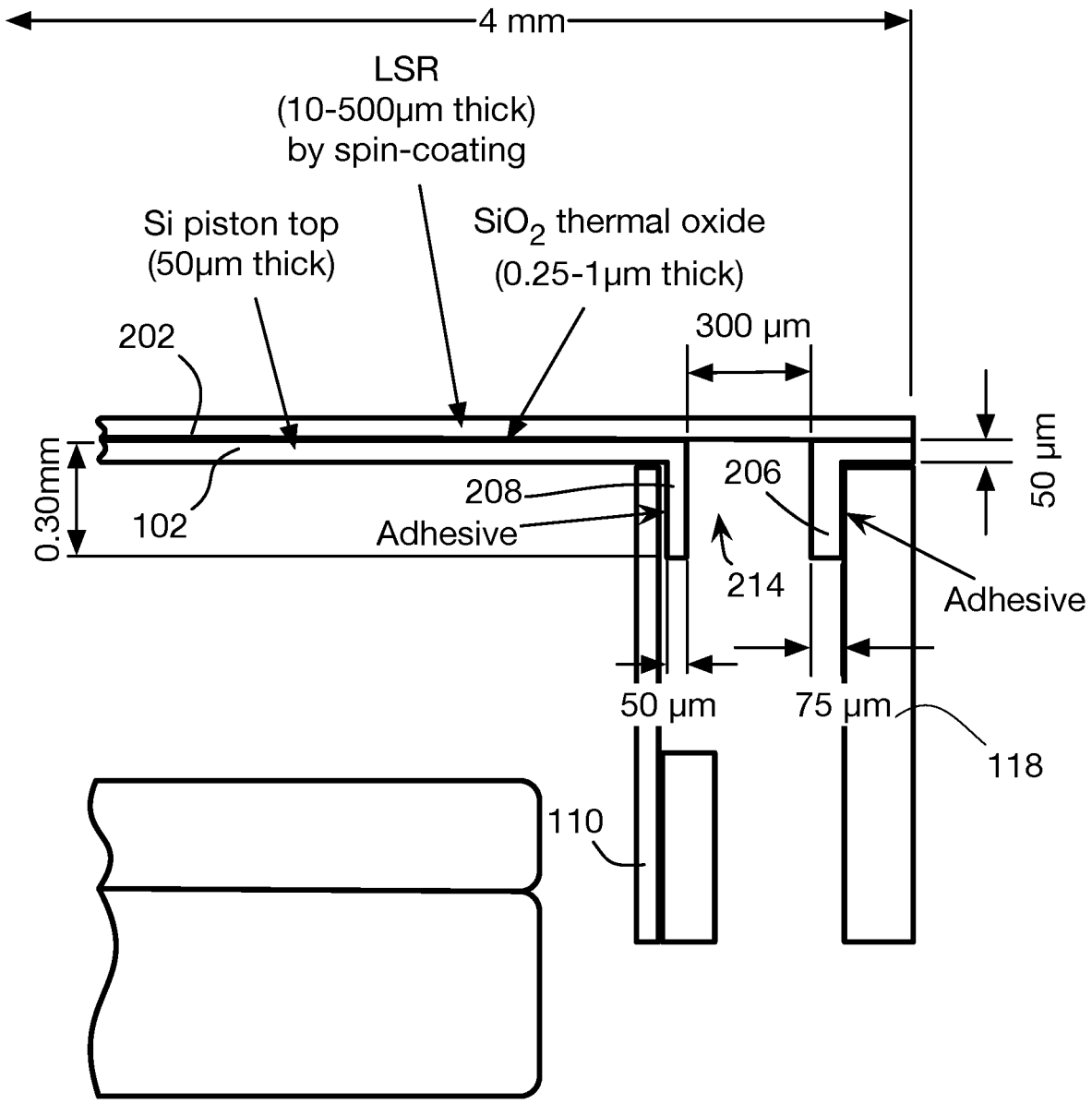
FIG. 4 shows a partial sectional view with dimensions of an example of the transducer.

FIG. 4 shows a detail of the cross-section of the transducer, with dimensions of one example implementation. Other implementations may have quite different dimensions. In this example, the suspension is formed from a layer 202 of liquid silicone rubber (LSR) 10-500 μm thick depending on desired suspension stiffness, formed by spin-coating the LSR on the silicon substrate. In some examples, the LSR layer is 30-80 μm thick, and in one particular example, it is about 50 μm thick. The piston top is between 10 and 100 μm thick, and in some cases around 50 μm thick, and is separated from the LSR by a 0.25-2 μm thick layer of SiO2 thermal oxide and/or 5-50 nm of Cr or other suitable material, as discussed below with regard to the fabrication process. The outer ring 208 of the piston 102 is 50 μm thick, and it is separated from the support ring 206 by a small gap 214 of around 300 μm. The support ring provides an adhesion area for the LSR at the top surface of the substrate, and includes a thinner wall, around 75 μm thick, extending down the inner face of the gap, providing a lip where the wall of the main housing may be attached. These dimensions allow the completed transducer to have an outer diameter only 4 mm across—substantially smaller than typical electrodynamic (voice coil moving a diaphragm) transducers (only one outer edge is shown in FIG. 4). Smaller sizes may be achieved, though with less space available inside the bobbin for the magnet and coin. With a magnet as small as 1.5 mm, a total transducer diameter of 3 mm may be achieved. Larger sizes may also be built using this method, though the piston may need to be thicker or have more reinforcing ribs as the aspect ratio (diameter to height) increases.

As shown in this example, the bobbin has an outer diameter matched to the inner diameter of the outer ring of the piston, so that the bobbin is contained inside the outer ring. This design contains any extra adhesive to the inside of the piston and outside of the housing ring, i.e., away from the gap between the piston and the housing, unlike in the example of FIG. 3B. Similarly, attaching the housing 118 to the outer periphery of the support ring keeps the adhesive for that joint out of the gap.

Figure 5A:
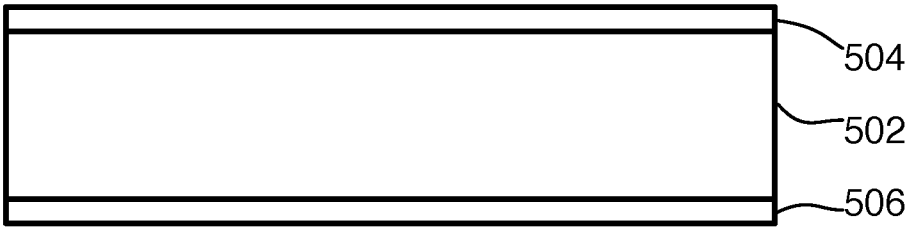
FIGS. 5A through 5K and 6A through 6M show MEMS fabrication processes for the piston and suspension of the transducer.
Figure 5B:
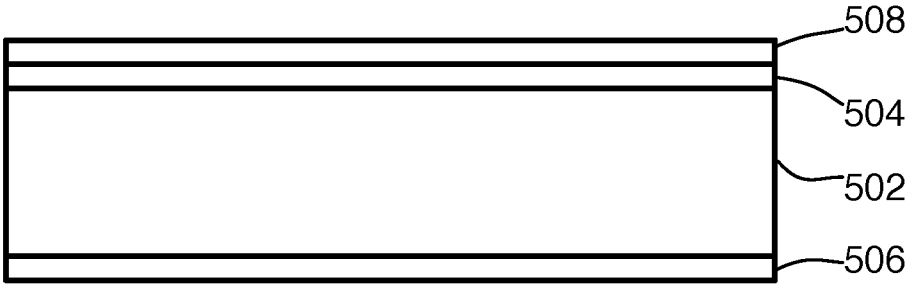
Figure 5C:
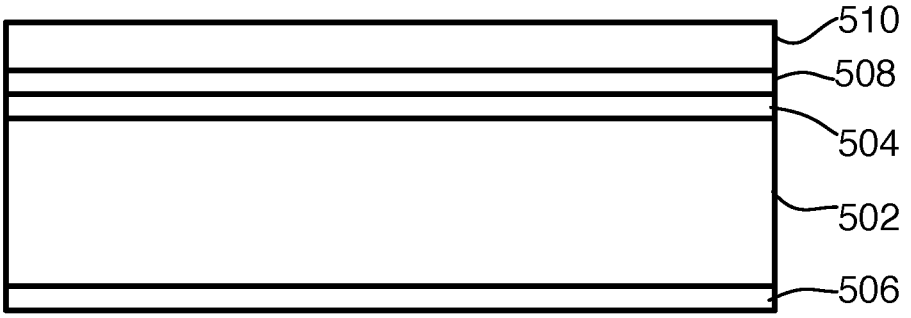
Figure 5D:
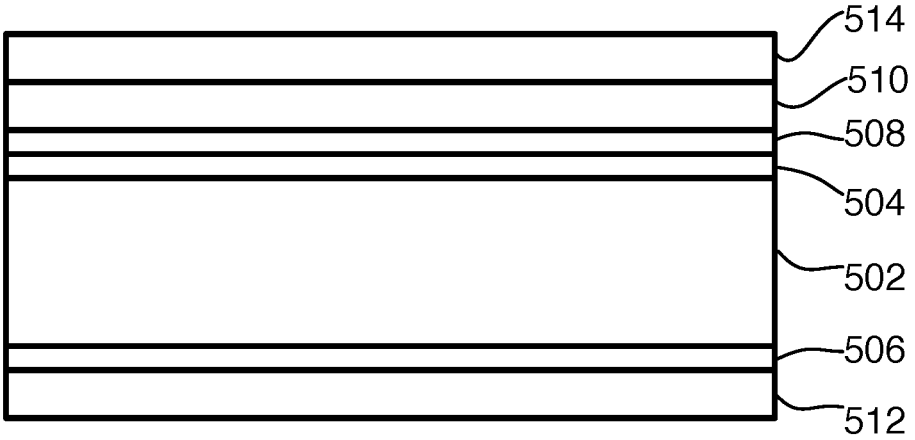
Figure 5E:
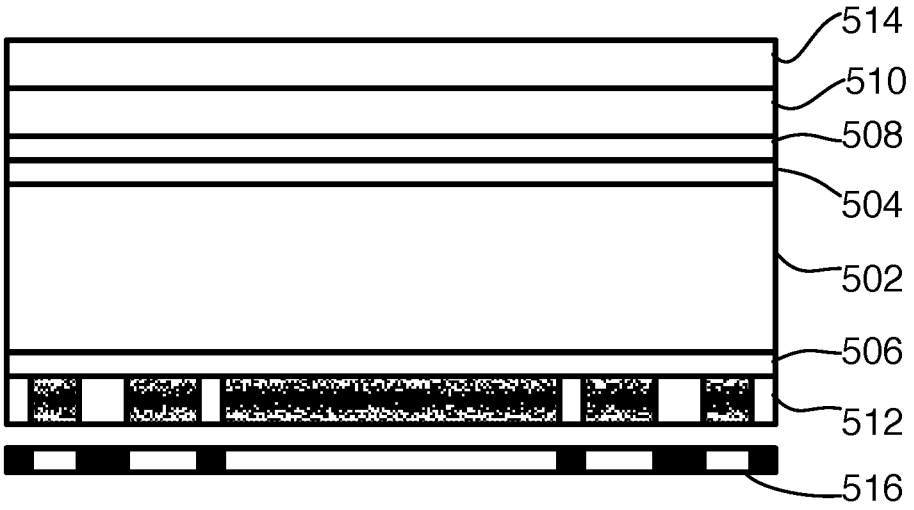
Figure 5F:
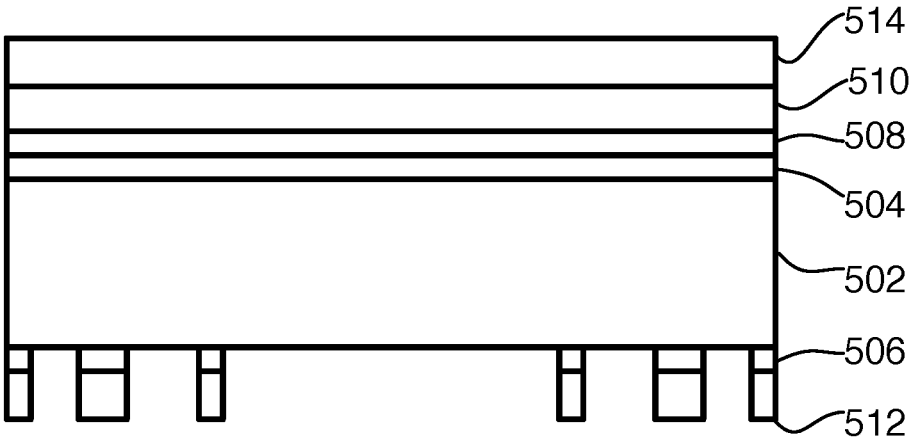
Figure 5G:
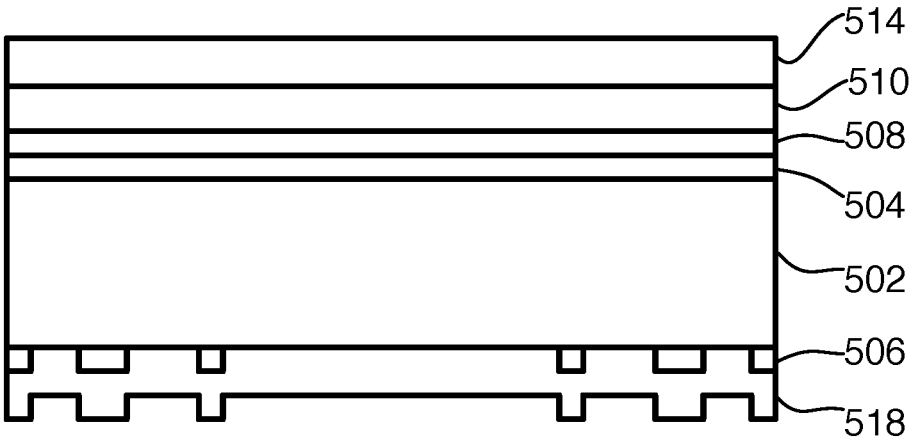
Figure 5H:
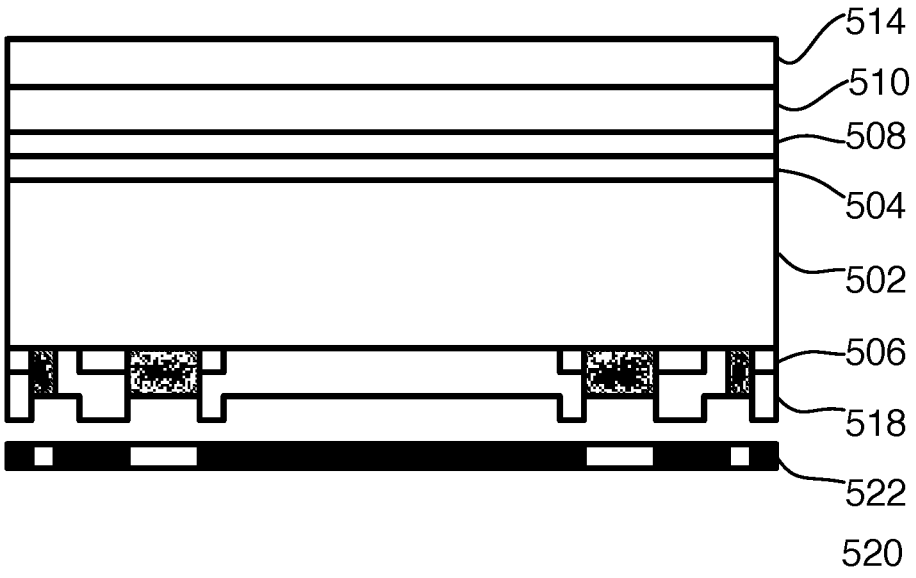
Figure 5I:
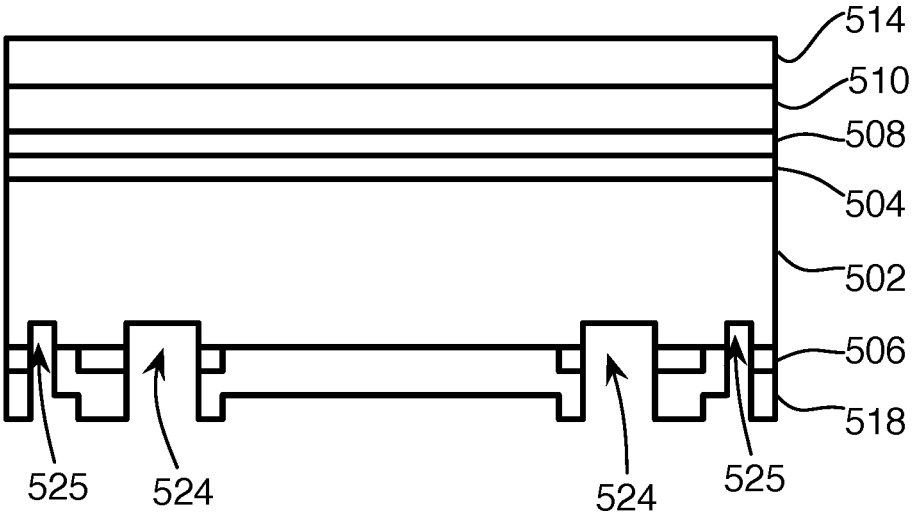
Figure 5J:
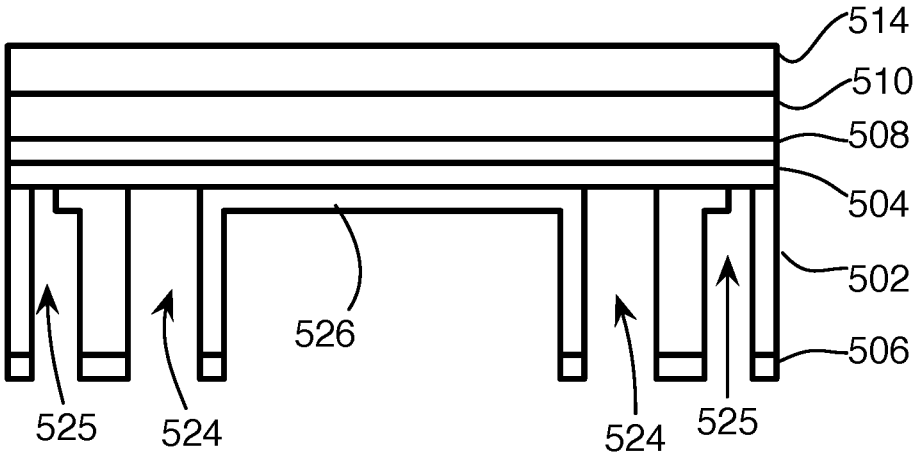
Figure 5K:
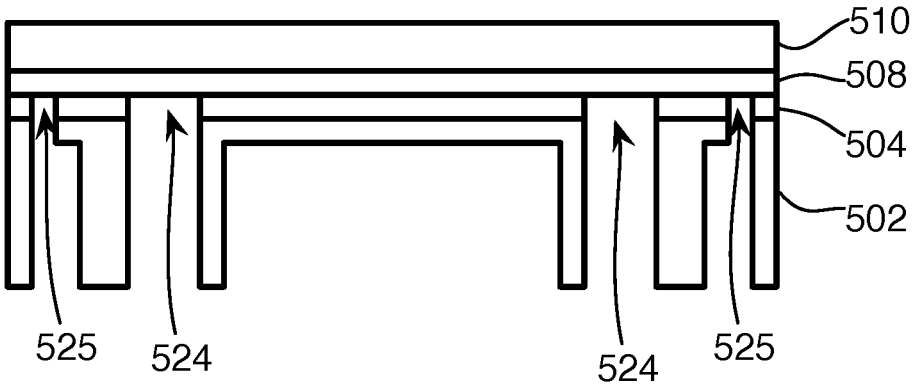

FIGS. 5A-5K show a cross-section of a silicon wafer as it goes through an example MEMS fabrication process to form the piston and suspension. Other MEMS processes, with different technologies used for patterning, masking, and etching may be used, with accordingly different process steps. The etch depths mentioned below are based on a 300 μm thick Si wafer and may be adjusted to achieve the desired characteristics of the Si piston, e.g., mechanical stiffness, moving mass, etc. The process steps are as follows:

1. Layers (504, 506) of thermal oxide ($SiO_2$) are grown on the top and bottom surfaces of a 300 μm thick Silicon wafer 502. (FIG. 5A)
2. A 5-50 nm thick layer 508 of Chromium is deposited on the top by physical vapor deposition (PVD). The Cr will serve as an etch-stop for later steps; other appropriate materials may be used. (FIG. 5B)
3. A 50 μm thick layer 510 of LSR is spin-coated on top of the Cr and cured. Thinner or thicker layers of LSR may be used, based on the properties of the LSR and the desired amount of excursion and stiffness in the speaker. (FIG. 5C)
4. Photoresist 512, 514 is spin-coated onto both sides. (FIG. 5D)
5. The bottom side is masked (516) and exposed to an appropriate light source to activate the photoresist 512. (FIG. 5E)
6. The photoresist layer is developed and used to mask reactive ion etching (RIE) or HF etching of the bottom SiO2 layer 506. (FIG. 5F)
7. The developed photoresist 512 on at least the lower surface is stripped and a new coating 518 is spin-coated. (FIG. 5G)
8. Another mask 522 is used to expose the photoresist 518 on the bottom side. (FIG. 5H)
9. The photoresist 518 is developed and used to mask deep reactive ion etching (DRIE) through 50 μm of the bottom of the Si wafer to create channels 524, 525 (note that these are circular channels in the wafer, viewed twice each in the cross-section). (FIG. 5I)
10. The bottom layer of photoresist 518 is stripped, and DRIE is used again to etch through the remaining 250 μm of the silicon wafer (FIG. 5J). Where the first DRIE etch was performed, the second etch goes completely through the wafer, extending the channels 524, 525 to the $SiO_2$ layer 504; the area that was protected by the second mask during the 50 μm etch remains 50 μm thick, as only 250 μm is removed, forming the plate 526 of the piston and the top surface of the support ring. The areas protected by the first mask remain protected by the $SiO_2$ 506 left behind after the RIE etch in step 6, and form the rings of the piston and housing and any other full thickness features, such as the stiffening ribs and rings mentioned above (not shown). In some examples, full-thickness features are also used to manage the DRIE process.
11. The remaining $SiO_2$ 506 at the bottom layer and at the top of the now-open channels 524, 525 between the piston and the housing is removed using RIE or HF, with the Cr layer 508 serving as an etch-stop to prevent the RIE or HF from etching the underside of the LSR layer 510 after etching the top $SiO_2$ layer 504 via the channels 524, 525. (FIG. 5K). The remaining photoresist layer 514 covering the LSR 510 is stripped.

The process shown above etches a channel 525 through the wafer around the outer support ring, allowing the piston/support ring/suspension unit to be cut out of the substrate. Many such units can be formed simultaneously in a single substrate, held in place by the LSR layer, and cut out as needed by either mechanical means, RIE, or laser-cutting. The inner wall of the bulk Si remaining outside the outermost channel 525 may serve as an alignment guide to the cutting process. As noted above, housings and bobbins may be attached to the support rings and pistons in bulk before they are cut out of the substrate, and the housings may also serve as alignment guides for the cutting operation. Curing the LSR layer helps control the pretension in the surround, to make the stiffness of the surround more linear. Without pretension, bending stiffness dominates near the neutral axial position of the piston (with no magnetic forces applied to the voice coil). At some piston excursion, the tensile stresses in the surround begin to dominate and cause the stiffness to increase. The pretension due to curing makes the overall stiffness greater but much more linear. In some examples, curing the LSR at 150° C. roughly doubles the near-neutral position stiffness.

Figure 6A:
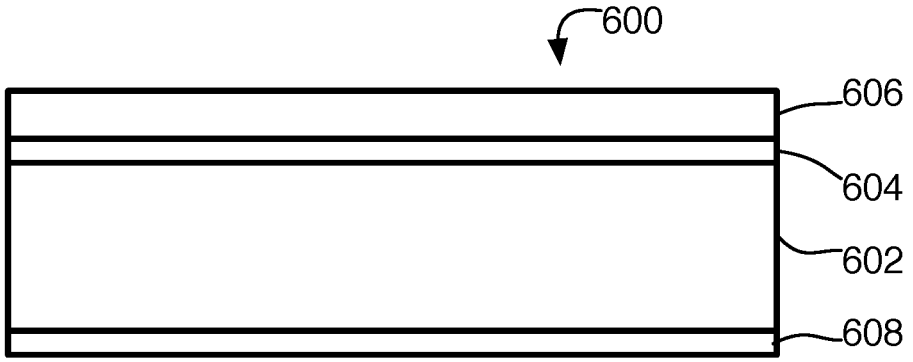
Figure 6B:
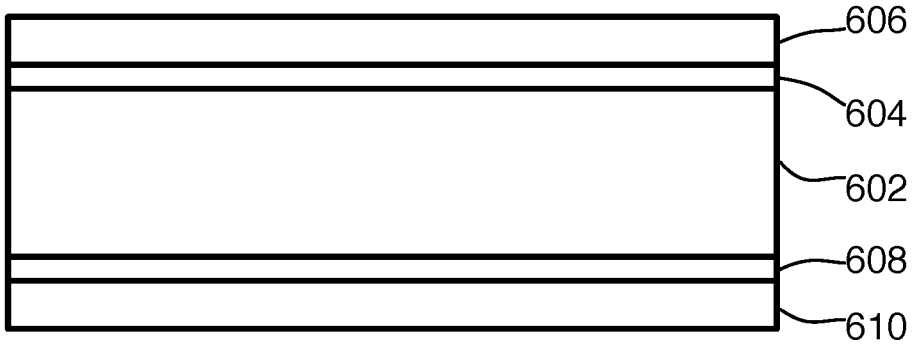
Figure 6C:
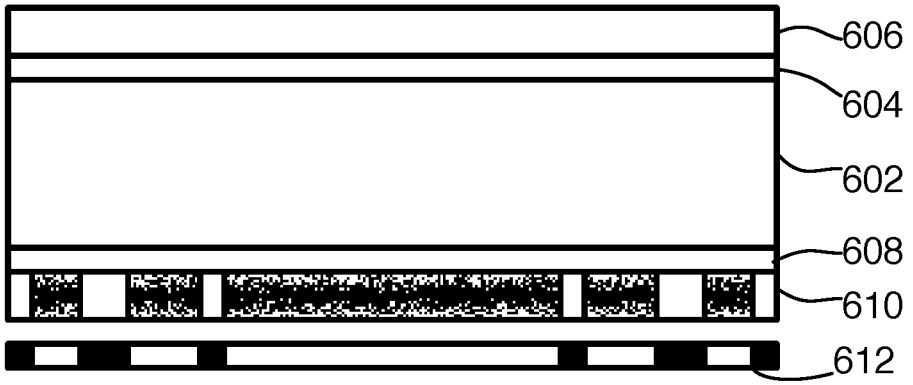
Figure 6D:
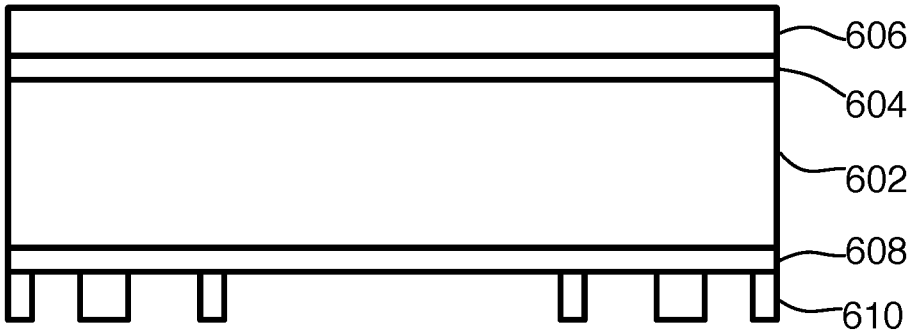
Figure 6E:
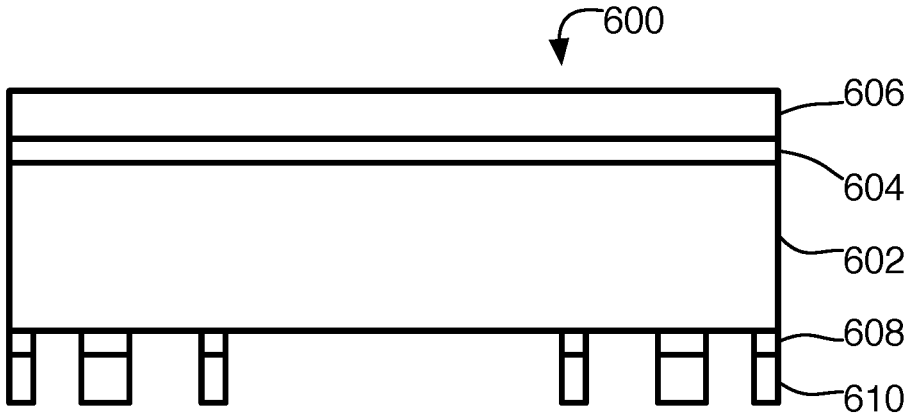
Figure 6F:
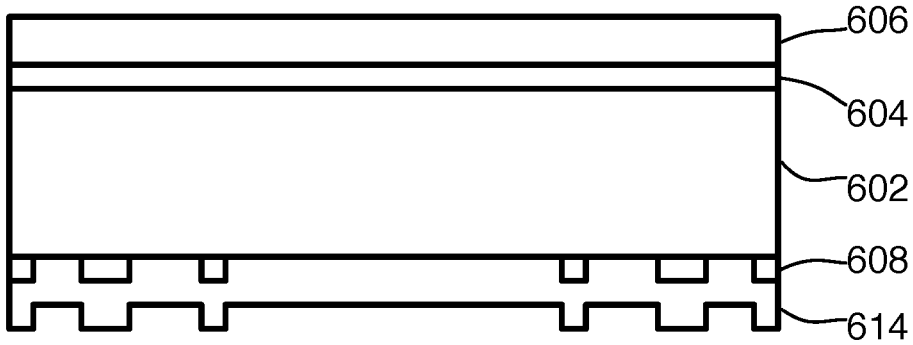
Figure 6G:
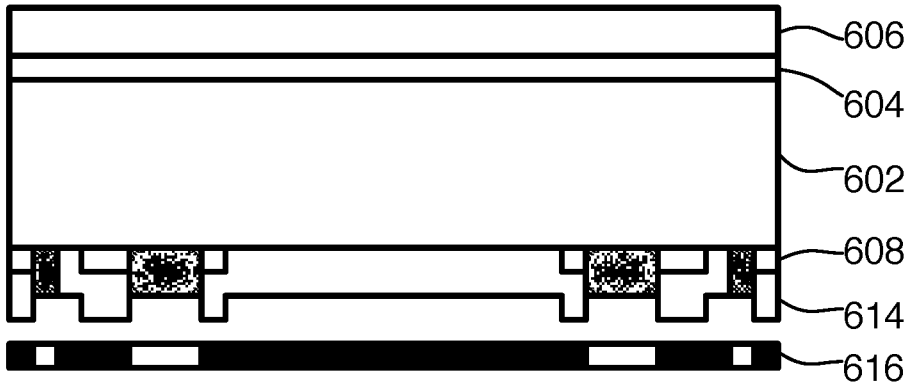
Figure 6H:
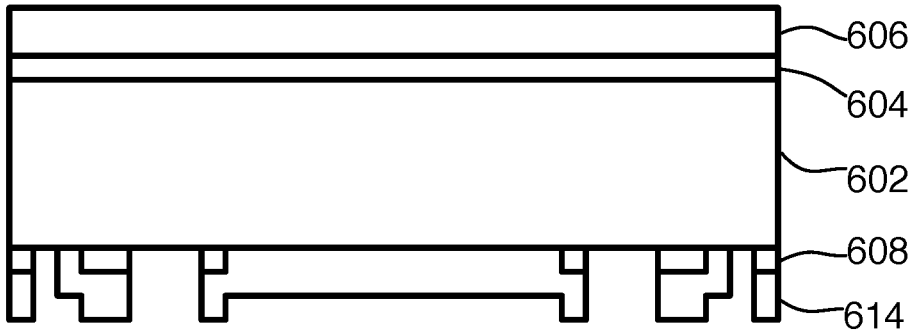
Figure 6I:
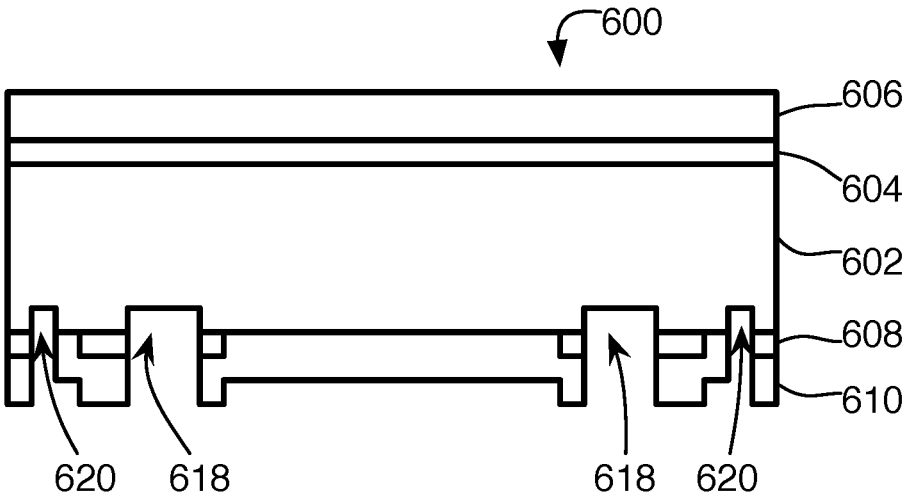
Figure 6J:
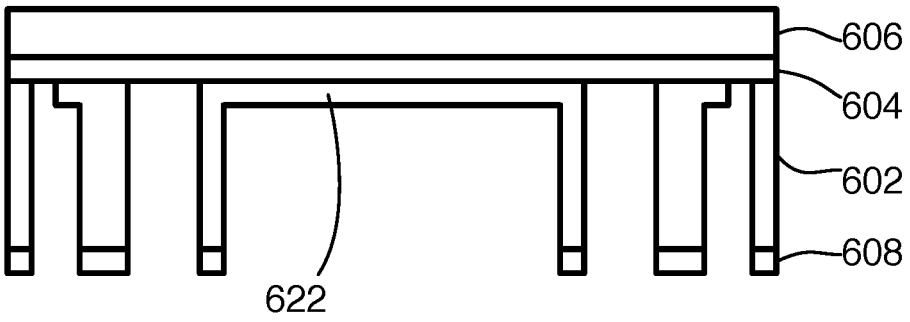

Another process flow is shown in FIG. 6A through 6M. This process begins with a Silicon-on-insulator (SOI) wafer 600 and delays the application of the LSR layer to late in the process, which may be more compatible with some MEMS fabrication workflows. The process steps are as follows:

1. The process begins with a SOI wafer having a first layer 602 of Si, oxide layers 604 and 608 on either side of the first Si layer, and a very thin (2-10 μm) second Si layer 606 bonded on top. (FIG. 6A)
2. A single layer 610 of photoresist is applied to the bottom of the wafer. (FIG. 6B)
3. The bottom side is masked (612) and exposed to an appropriate light source to activate the photoresist 610. (FIG. 6C)
4. The photoresist layer is developed and used to mask reactive ion etching (RIE) or HF etching of the bottom $SiO_2$ layer 608. (FIG. 6D-E)
5. The developed photoresist 610 is stripped and a new coating 614 is spin-coated. (FIG. 6F)
6. Another mask 616 is used to expose the photoresist 614 on the bottom side. (FIG. 6G)
7. The photoresist 614 is developed to create a new mask that covers the remaining $SiO_2$ 608 and part of the main silicon layer 602. (FIG. 6H)
8. Deep reactive ion etching (DRIE) through 50 μm of the bottom of the Si layer 602, masked by the photoresist 614, creates channels 618, 620 (note again that these are circular channels in the wafer, viewed twice each in the cross-section). (FIG. 6I)
9. The bottom layer of photoresist 614 is stripped, and DRIE is used again to etch through the remaining 250 μm of the silicon wafer (FIG. 6J). As before, where the first DRIE etch was performed, the second etch goes completely through the wafer, extending the channels 618, 620 to the top $SiO_2$ layer 604; the area that was protected by the second mask during the 50 μm etch remains 50 μm thick, as only 250 μm is removed, forming the plate 622 of the piston and the top surface of the support ring. The areas protected by the first mask remain protected by the $SiO_2$ 608 left behind after the RIE etch in step 4, and form the rings of the piston and support ring and any other full thickness features, such as the stiffening ribs and rings mentioned above (not shown). In some examples, full-thickness features are also used to manage the DRIE process.

Figure 6K:
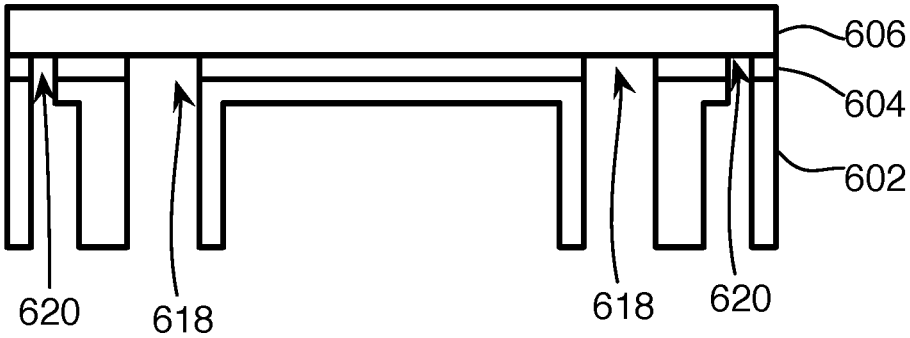

10. The remaining $SiO_2$ 608 at the bottom layer and at the top of the now-open channels 618, 620 between the piston and the housing is removed using RIE or HF. (FIG. 6K)

Figure 6L:
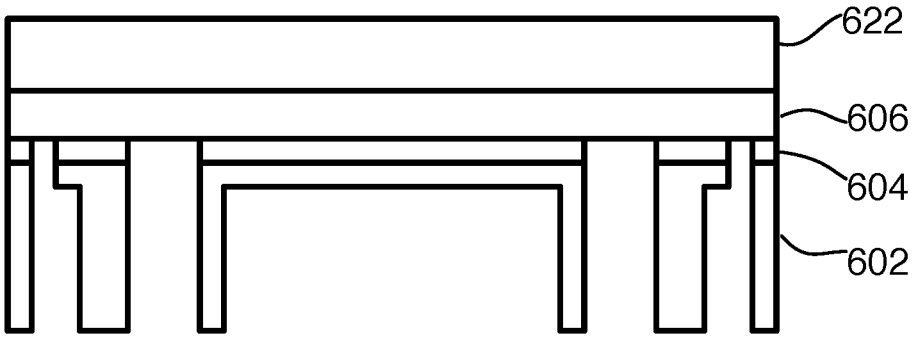
Figure 6M:
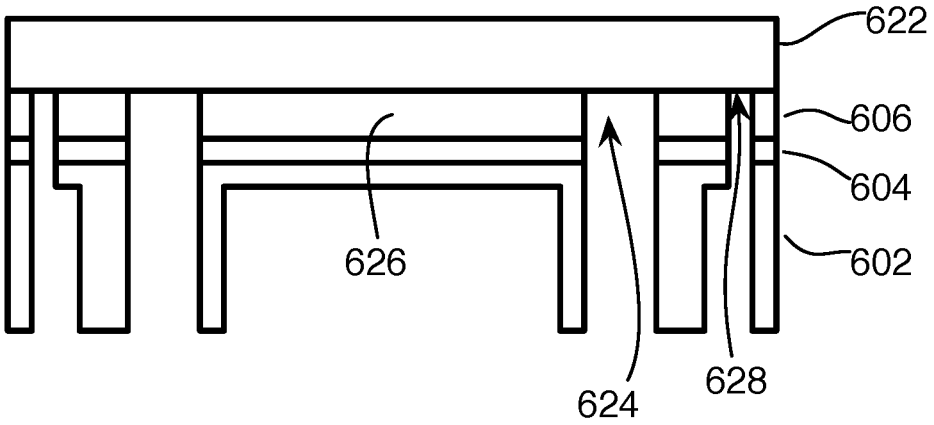

11. A 50 μm thick layer 622 of LSR is now spin-coated on top of the top Si layer 606 and cured. Thinner or thicker layers of LSR may be used, based on the properties of the LSR and the desired amount of excursion and stiffness in the speaker. (FIG. 6L)

12. To release the piston 622, the Si of the thin top layer 606 is etched using an isotropic $XeF_2$ etch. This etch is effectively masked by the much thicker (even where nearly etched through) bottom Si layer 602—while 5 μm of the piston layer may be lost, 45 μm remain, combined with the 5 μm of the top layer that are protected between the bottom layer and the LSR. Vertical Si areas will not be etched as they are still protected by a passivation layer deposited during the DRIE step. Other isotropic or anisotropic etching techniques (e.g., RIE using chlorine or fluorine chemistries, KOH, TMAH) may be used instead of XeF2 for this release step.

As compared to the first example, because the LSR is added late in the process, the top layer of photoresist is not needed.

A number of implementations have been described. Nevertheless, it will be understood that additional modifications may be made without departing from the scope of the inventive concepts described herein, and, accordingly, other embodiments are within the scope of the following claims.

What is claimed is:

1. A diaphragm and suspension assembly for an electroacoustic transducer, the assembly comprising:

a piston comprising a disk of silicon having a flat surface, the flat surface serving as the diaphragm;

a support ring of silicon surrounding the piston and separated from the piston by a gap;

a layer of compliant material adhered to a top surface of the support ring and to the flat surface of the piston, suspending the piston in the gap, the compliant material having a mechanical stiffness in the range of 5-100 N/m.

2. The piston and suspension assembly of claim 1, wherein the piston further comprises a void within the disk of silicon, bounded by a perimeter wall of the disk and the top surface of the disk.

3. The piston and suspension assembly of claim 1, wherein the support ring comprises an inner perimeter wall of silicon facing the gap, and an outer lip having less height than the inner perimeter wall.

4. The piston and suspension assembly of claim 1, wherein the compliant material has an elastic strain limit of at least 50 percent.

5. The piston and suspension assembly of claim 1, wherein the compliant material has an elastic strain limit of at least 150 percent.

6. The piston and suspension assembly of claim 1, wherein the support ring has an outer diameter of around 3 mm.

7. The piston and suspension assembly of claim 1, wherein the compliant material comprises liquid silicone rubber (LSR).

8. The piston and suspension assembly of claim 1, wherein the support ring has an outer diameter of around 4 mm.

9. The piston and suspension assembly of claim 1, wherein the piston has a thickness of between 10 and 100 μm.

10. The piston and suspension assembly of claim 9, wherein the piston has a thickness of about 50 μm.

11. The piston and suspension assembly of claim 1, wherein the layer of compliant material is between 10 and 500 μm thick.

12. The piston and suspension assembly of claim 1, wherein the layer of compliant material is around 50 μm thick.

13. An electro-acoustic transducer comprising:

a piston comprising a disk of silicon having a flat surface, the flat surface serving as a diaphragm of the transducer;

a support ring of silicon surrounding the piston and separated from the piston by a gap;

a layer of compliant material adhered to a top surface of the support ring and to the flat surface of the piston, suspending the piston in the gap, the compliant material having a mechanical stiffness in the range of 5-100 N/m;

a bobbin coupled to the piston;

a ferromagnetic housing coupled to the support ring; and a magnet/voice-coil system coupled to the housing and bobbin for converting electrical current to motion of the piston.

14. The transducer of claim 13, wherein:

the piston further comprises perimeter wall of the disk and the top surface of the disk, the perimeter wall and top surface bounding a void within the disk of silicon; and the bobbin is adjacent to an inner perimeter of the perimeter wall of the disk.

15. The transducer of claim 13, wherein:

the support ring comprises an inner perimeter wall of silicon facing the gap, and an outer lip having less height than the inner perimeter wall; and the ferromagnetic housing is adjacent to an outer perimeter surface of the inner perimeter wall and a bottom surface of the outer lip.

* * * * *